United States Patent [19]

Leathers et al.

[11] 4,067,075

[45] Jan. 10, 1978

[54] INFLATABLE STRETCHER

[76] Inventors: Kenneth L. Leathers, Rte. 2, Box 475 K; T. J. Botner, Rte. 3, Box 582, both of Ontario, Oreg. 97914

[21] Appl. No.: 408,698

[22] Filed: Oct. 23, 1973

[51] Int. Cl.[2] ..... A61G 1/00

[52] U.S. Cl. ..... 5/82 R; 5/349; 9/13; D6/201

[58] Field of Search ..... 5/82, 91, 344, 345 R, 5/345 B, 348 R, 348 WB, 349, 350; D6/201, 202, 203, 204; 9/11 A, 13

[56] References Cited

U.S. PATENT DOCUMENTS

| | | | |
|---|---|---|---|
| D. 174,810 | 5/1955 | Haller | D6/201 |
| 2,369,736 | 2/1945 | Hurt | 5/348 R |
| 3,056,980 | 10/1962 | Holladay | 9/13 |
| 3,775,782 | 12/1973 | Rice et al. | 9/11 A |

FOREIGN PATENT DOCUMENTS

| | | | |
|---|---|---|---|
| 494,496 | 7/1950 | Belgium | 5/348 R |
| 1,414,479 | 11/1964 | France | 5/82 |

*Primary Examiner*—Paul R. Gilliam
*Assistant Examiner*—Kenneth J. Dorner

[57] ABSTRACT

The inflatable stretcher comprises a top structure having a plurality of herringbone pattern inflatable compartments, a bottom pad having a layer construction including reinforcing cords, a plurality of handles which project from the terminal side of the structure and which may be connected to aforesaid reinforcing cords, and an inflating stem.

3 Claims, 3 Drawing Figures

INFLATABLE STRETCHER

FIELD OF INVENTION

The present invention relates to lifters and stretchers, more particularly to inflatable lifters and stretchers.

DESCRIPTION OF THE PRIOR ART

A variety of lifters and stretchers having collapsable frameworks and foldable web members have been offered in the prior art. These collapsable frameworks have also been provided with inflatable or granular filled mattress means in lieu of web members and the like. Common to all such lifters and stretchers of the prior art is that the structure is not easily stored or light weight.

Accordingly, it is an object of the present invention to provide an improved inflatable stretcher.

It is a further object of this invention to provide an inflatable structure which may conform about the body of a patient to sure against displacements and to transport the patient without hazard or painful pressure even if the lifter is in an incline position.

These and other objects shall become apparent from the description following, it being understood that modifications may be made without affecting the teachings of the invention here set out.

SUMMARY OF THE INVENTION

The inflatable stretcher comprises a top structure having a plurality of herringbone pattern inflatable compartments, a bottom pad having a layer construction including reinforcing cords, a plurality of handles which project from the terminal side of the structure and which may be connected to aforesaid reinforcing cords, and an inflating stem.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
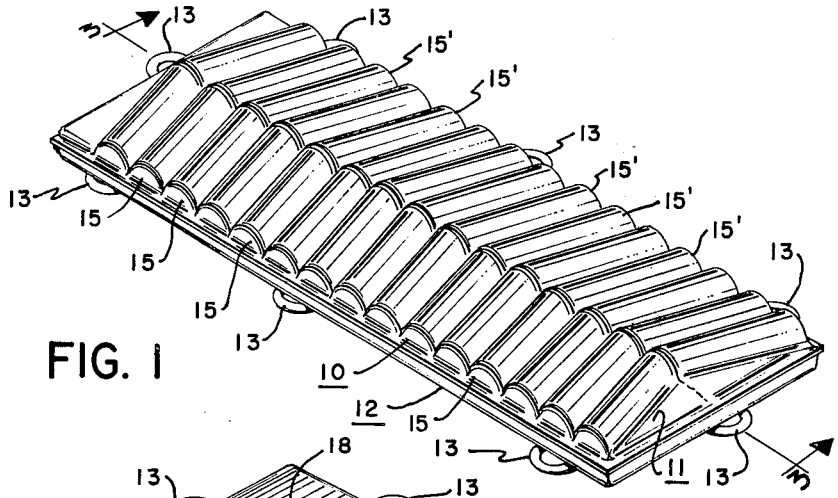
FIG. 1 is a top perspective view of the inflatable stretcher of this invention.
Figure 2:
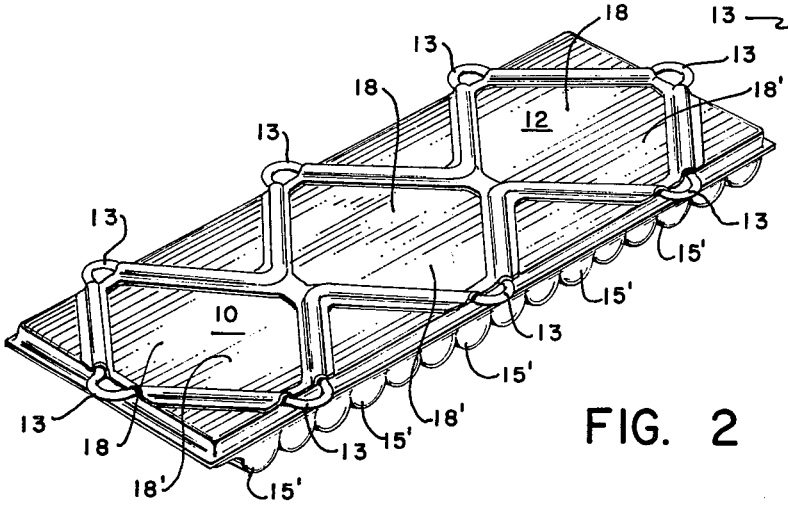
FIG. 2 is a bottom perspective view of the apparatus of the FIG. 1.

Referring to the drawings and more particularly to the FIGS. 1 and 2 the inflatable stretcher of this invention is shown to advantage and is generally identified by the numeral 10. The inflatable stretcher 10 comprises a top structure 11 and a bottom pad 12, a plurality of handles 13 and an inflating stem 14.

Figure 3:
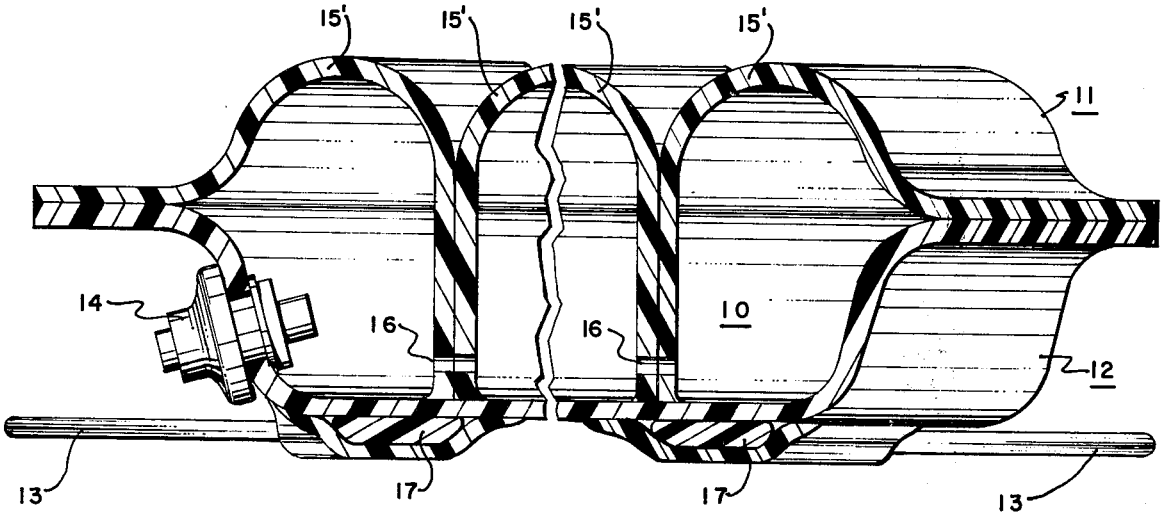
FIG. 3 is a fragmentary cross-sectional view taken along the lines 3—3 of the FIG. 1 showing the interior configuration thereof.

Referring to the FIGS. 1 and 3, the top structure 11 is fabricated of polymer or elastomer coated fabric or other suitable materials, and comprises a plurality of compartments 15 and 15'. Compartments 15 and 15' issue to each side of the rectilinear center of the stretcher 10 at opposing angles in an herringbone-like pattern. This pattern of compartments 15 and 15' is intended to provide support which distributes itself in accordance with the contour of the body as a result of subsequent inflation. The inflated stretcher 10 consolidates the form which is assumed and hence provides a firm hold, issuing over a large area and secures against displacements for the patient on the stretcher. As shown in the FIG. 3, the compartments 15 and 15' may be welded or seamed to the interior terminal side of the bottom pad 12 by means of thermal bonding adhesives or commonly known seaming methods. The interior portions of the compartments 15 and 15' are provided with passageways 16 which permit gas to pass between their respective adjacent compartments of the compartments 15 and 15' throughout the stretcher 10 to permit inflation from a single valve point to be described hereinafter.

Referring to the FIGS. 2 and 3, the bottom pad 12 is a laminated layer of flexible film which may be fabricated of polymer, elastomer, coated fabrics or other suitable materials. The top structure 11 and the bottom pad 12 are laminated about their outermost edges by means of conventional seams, thermal bonding or forming bonding, adhesives and the like. It may be seen that the bottom pad 12 is fabricated of thicker stock than the top structure 11 to provide protection from commonly encountered potential punctures, and to provide support to the inflatable stretcher 10. The bottom pad 12 is further provided with reinforcing cord 17 in a crossing pattern which generally describe diamond shaped enclosures 18 over the lowermost terminal side of the stretcher 10. The cords 17 may be fabricated of any of a number of materials including wound nylon filaments, and may be laminated between layers of material comprising the bottom pad 12 as shown in the FIG. 3. Further, diamond shaped pads 18' may be laminated in each of the rigidly figured diamond shaped enclosures 18 to provide for additional puncture protection and support. The handles 13 may be fabricated as a part of the cords 17 and may project from the outermost terminal sides of the stretcher 10 at suitable predetermined intervals.

The inflating valve 14 may be positioned at one of the terminal ends of the inflatable stretcher 10 to permit inflation and deflation. The valve 14 may be suitably configured to receive the discharge end of a pump (not shown). This pump may be of the type which may be constructed of impermeable elastomers, polymers, fabric, or other materials which may be suitably contained in the structure, or adjacent an air compartment. The valve 14 may also be adapatable to a cylinder containing compressed gas.

In operation, the stretcher 10 may be inflated by means of valve 14 as set out above. A patient may be disposed on the stretcher and the stretcher may be lifted by two or more people by means of the handles 13. It may be seen that the inflated stretcher 10 provides resilient support to the patient and provides a controllable supported structure by which the patient may be lifted.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

We claim:

1. An inflatable stretcher, comprising:

a top structure being fabricated of a suitably flexible air tight material and including a plurality of inflatable compartments, each of said compartments issuing to each side of the longitudinal center line of said stretcher at opposing angles in a herring-bone-like pattern, said compartments communicating with each other to inflate from a single inflating stem;

a bottom pad being laminated to said top structure; and handles fastened to the terminal edges at intervals from said stretcher.

2. The apparatus of claim 1 wherein said bottom pad is provided with reinforcing cords disposed diagonally to said pad which meet in a criss-cross pattern and wherein said handles are fastened to said reinforcing cords.

3. The apparatus of claim 2 wherein said bottom pad is fabricated as a laminated structure of layers wherein said reinforcing cords are laminated between said layers.

* * * * *